United States Patent [19]

Allen et al.

[11] Patent Number: 5,046,855

[45] Date of Patent: Sep. 10, 1991

[54] MIXING APPARATUS

[75] Inventors: Thomas E. Allen, Comanche; Kevin D. Edgley, Duncan, both of Okla.

[73] Assignee: Halliburton Company, Duncan, Okla.

[21] Appl. No.: 412,255

[22] Filed: Sep. 21, 1989

[51] Int. Cl.[5] ..... B01F 15/02

[52] U.S. Cl. ..... 366/137; 137/605; 137/625.3; 137/897; 366/165; 366/65

[58] Field of Search ..... 366/2, 6, 14, 15, 17, 366/28, 29, 65, 60, 136, 137, 159, 165, 279; 137/605, 625.3, 896, 897, 898, 625.31

[56] References Cited

U.S. PATENT DOCUMENTS

| | | | |
|---|---|---|---|
| 1,306,210 | 6/1919 | Zucker | 137/605 |
| 1,429,574 | 9/1922 | Mattingly | 137/605 |
| 2,743,909 | 5/1956 | Lawlor | 366/136 |
| 3,231,245 | 1/1966 | Harvey | 259/153 |
| 3,846,079 | 11/1974 | Alagy | 366/136 |
| 4,077,612 | 3/1978 | Ricciardi | 366/165 |
| 4,184,771 | 1/1980 | Day | 366/3 |
| 4,764,019 | 8/1988 | Kaminski et al. | 366/15 |
| 4,830,505 | 5/1989 | Dunton | 366/136 |
| 4,863,277 | 9/1989 | Neal et al. | 366/137 |

OTHER PUBLICATIONS

Halliburton Services publication entitled "Halliburton Modular Recirculating Cement Mixer (RCM TM) System", dated at least one year prior to Aug. 1989.

Byron Jackson Inc. brochure entitled "New BJ PSB Precision Slurry Blender", dated at least one year prior to Aug. 1989.

BJ-Titan publication entitled "The Ram-Recirculating Averaging Mixer for Consistent Slurry Weight", and attached BJ Hughes Product Information Equipment Specification entitled Dual RAM, dated at least one year prior to Aug. 1989.

Magcobar-Dresser publication entitled "The Magcobar Cementing System", dated at least one year prior to Aug. 1989.

The Western Company brochure entitled "Western Offshore Cementing Services", dated at least one year prior to Aug. 1989.

*Primary Examiner*—Robert W. Jenkins

*Attorney, Agent, or Firm*—James R. Duzan; E. Harrison Gilbert, III

[57] ABSTRACT

A mixing apparatus includes a tub, an agitator disposed in the tub, a flow mixer which provides an initial mixture into the tub, and recirculating means for recirculating mixture from the tub through the flow mixer. In a particular embodiment, the flow mixer has a vertical sleeve through which a dry substance is received for mixing with a liquid input through an inlet manifold through which the sleeve extends. The flow mixer also includes a valve comprising an orifice plate, a valve plate and a body in which grooves are formed for forming jets of liquid to engage the dry substance in a downwardly spiraling circulation. Connected to the flow mixer below the valve are at least two recirculation inputs below which a diffuser is adjustably connected.

43 Claims, 6 Drawing Sheets

MIXING APPARATUS

BACKGROUND OF THE INVENTION

This invention relates generally to apparatus for mixing at least two substances, such as dry cement and water. This invention relates more particularly, but not by way of limitation, to an inlet flow mixer and apparatus incorporating an inlet flow mixer with which a cement slurry can be formed for use in an oil or gas well.

After the bore of an oil or gas well has been drilled, typically a tubular string, referred to as casing, is lowered and secured in the bore to prevent the bore from collapsing and to allow one or more individual zones in the geological formation or formations penetrated by the bore to be perforated so that oil or gas from only such zone or zones flows to the mouth of the well. Such casing is typically secured in the well bore by cement which is mixed at the surface, pumped down the open center of the casing string and back up the annulus which exists between the outer diameter of the casing and the inner diameter of the well bore.

The mixture of cement to be used at a particular well usually needs to have particular characteristics which make the mixture, referred to as a slurry, suitable for the downhole environment where it is to be used. For example, from one well to another, there can be differences in downhole pressures, temperatures and geological formations which call for different types of cement slurries. Through laboratory tests and actual field experience, a desired type of cement slurry, typically defined at least in part by its desired density, is selected for a particular job.

Once the desired type of cement slurry has been selected, it must be accurately produced at the well location. If it is not, adverse consequences can result. During the mixing process, the slurry density has typically been controlled with the amount of water. Insufficient water in the slurry can result in too high density and, for example, insufficient volume of slurry being placed in the hole. Also, the completeness of the mixing process can affect the final properties of the slurry. A poorly mixed slurry can produce an inadequate bond between the casing and the well bore. Still another example of the desirability of correctly mixing a selected cement slurry is that additives, such as fluid loss materials and retarders, when used, need to be distributed evenly throughout the slurry to prevent the slurry from prematurely setting up. This requires there to be sufficient mixing energy in the slurry blending process. More generally it is desirable to obtain a consistent, homogeneous slurry by means of the mixing process. This should be done quickly so that monitored samples of the slurry are representative of the larger volume and so that dry and wet materials are completely or thoroughly combined to obtain the desired slurry.

The foregoing objectives have been known and attempts have been made to try to meet them with continuous mixing systems. In general, these systems initially mix dry cement and water through an inlet mixer which outputs into a tub in which one or more agitators agitates the resulting blend of materials. The process is continuous, with slurry which exceeds the volume of the tub flowing over a weir into an adjacent tub which may also be agitated and from which slurry is pumped down into the well bore. Such systems typically also include some type of recirculation from one or the other of the tubs back into the inlet mixer and the first tub to provide an averaging effect as well as possibly some mixing energy. One or more densimeters are typically used in the systems to monitor density (this is the means the operator uses to determine cement/water ratio), the primary characteristic which is used to determine the nature of the cement slurry.

Despite these mixing systems having significant utility, the oil and gas industry today is seeking systems which provide better mixing than such continuous mixing systems have been able to achieve. It has been observed that in some prior systems the inlet mixer configuration provides inadequate mixing energy and causes, rather than reduces, air entrainment. Excess air entrainment can adversely affect density measurements which in turn affect control systems and thus resultant slurry properties. Inadequate mixing can also allow "dusting" (escape of unmixed dry cement from the mixer). Other shortcomings of at least some prior continuous mixing systems include the necessity of controlling multiple mixing water valves, and in at least one type of system, one of such valves chokes the water source pressure upstream of where mixing occurs so that much of the mixing energy is lost. At least one prior system includes a primary water inlet valve which has an adjustable conical space that can become clogged by debris in the water.

Although the prior continuous mixing systems have served and continue to serve useful purposes, there is the need for an improved mixing apparatus which overcomes one or more, and preferably all, the aforementioned shortcomings. There is the need for a mixing apparatus which has enough mixing energy to mix thick slurries. This would preferably include a high energy primary mixer, more preferably a constant velocity jet type inlet mixing device. This would also include providing increased tank rolling action and increased recirculation rates. There are also the need to reduce air entrainment and the need to increase the available mixing rate at which at least conventional slurries can be mixed. There is also the need to insure better wetting of dry substances which are to be mixed to reduce "dusting." It is also desirable to have a mixing apparatus wherein a single fluid control valve is used for simplifying the control. Such a control valve should be one which is less susceptible to clogging, has a relatively fast response and can be adapted for different gain adjustments. It should also not choke the inlet flow so that significant mixing energy is not lost before reaching the mixing chamber.

SUMMARY OF THE INVENTION

The present invention overcomes the above-noted and other shortcomings of the prior art by providing a novel and improved mixing apparatus. The present invention more particularly provides a novel and improved inlet flow mixer and a novel and improved apparatus incorporating such a flow mixer with a mixing tub and related components with which a cement slurry can be formed for use in an oil or gas well, for example. Within the inlet flow mixer is a novel and improved valve.

An advantage of the present invention is that it can be used to mix thick slurries as well as more conventional slurries. The present invention provides high mixing energy, increased slurry rolling action within a tub and increased recirculation rates. Despite the high mixing energy in the present invention, the present invention reduces air entrainment. The present invention permits increased mixing rates to be obtained. The present invention more fully wets input dry substances so that there is little or no dusting. The present invention also utilizes a single inlet fluid control valve for permitting simpler control. This valve is less susceptible to clogging, has a fast response and can be adapted for different gain adjustments. It also does not choke inlet fluid pressure to the extent of producing any significant loss of mixing energy from the inlet fluid. That is, any choking is done at the point of mixing where potential energy (pressure) is converted into kinetic energy (velocity). The resultant high velocity that is produced is useful for mixing. Also with the design of the present invention, a water bypass valve which has been used in prior designs can be eliminated.

The present invention provides an axial flow mixer, comprising: a first inlet member, the first inlet member having defined therein an entry port and an axial opening, the axial opening including an exit port communicating with the entry port; a second inlet member, the second inlet member received in the axial opening of the first inlet member and the second inlet member having an axial passageway defined therethrough; an orifice plate connected to the first inlet member, the orifice plate having defined therein a plurality of orifices disposed below the exit port of the first inlet member; and a valve plate having a plurality of apertures defined therein, the valve plate disposed between the first inlet member and the orifice plate for movement relative thereto so that the apertures of the valve plate can be selectably registered with the orifices of the orifice plate to control the flow of a liquid communicated through the entry port of the first inlet member for mixing with a substance received through the axial passageway of the second inlet member.

In a preferred embodiment, the axial flow mixer further comprises an axial body connected to the orifice plate in coaxial relation to the second inlet member, which body has a plurality of grooves defined therein for directing streams of the liquid exiting the orifices with which the apertures register so that the directed streams form a flow circulating about the axis of the axial body. This preferred embodiment further comprises at least two recirculation inlets connected to the axial body, and a diffuser member connected to the axial body so that the circulating flow engages the diffuser member for changing the direction of flow of the circulating flow.

The present invention also provides an apparatus for producing a mixture from a dry substance and a liquid, comprising: flow mixing means for mixing a dry substance and a liquid in a downwardly spiraling flow, the flow mixing means including at least two recirculation inlets; a tub having the flow mixing means disposed therein, the tub having a larger cross-sectional area at its top than at its bottom; an agitator disposed obliquely in the tub so that the agitator, when activated, circulates a mixture received in the tub from the flow mixing means; and recirculation means, connected to the tub and to at least two recirculation inlets, for recirculating the mixture from the tub into the downwardly spiraling flow within the flow mixing means.

The present invention also provides a valve, comprising: an orifice plate having a plurality of orifices defined therein; and a valve plate pivotably connected to the orifice plate so that the position to which the valve plate is pivoted determines which of the orifices are open to pass a liquid. In a preferred embodiment the valve further comprises jet means, connected to the orifice plate, for directing into a circulating flow liquid passed through open orifices of the orifice plate. In a preferred embodiment, the orifice plate defines orifice means for providing a selectable area through which a substance can be controllably flowed; and the valve plate defines adjustment means, connected to the orifice means, for permitting the opening of areas, $A_n$, through the orifice means, which areas permit flows of the substance at respective volumetric flow rates, $Q_n$, so that the substance flows through the valve at a constant velocity, $Q_n/A_n$.

Therefore, from the foregoing, it is a general object of the present invention to provide a novel and improved mixing apparatus, particularly an axial flow mixer, a valve thereof and an apparatus for producing a mixture from a dry substance and a liquid. Other and further objects, features and advantages of the present invention will be readily apparent to those skilled in the art when the following description of the preferred embodiment is read in conjunction with the accompanying drawings.

DETAILED DESCRIPTION OF THE PREFERRED EMBODIMENT

Figure 1:
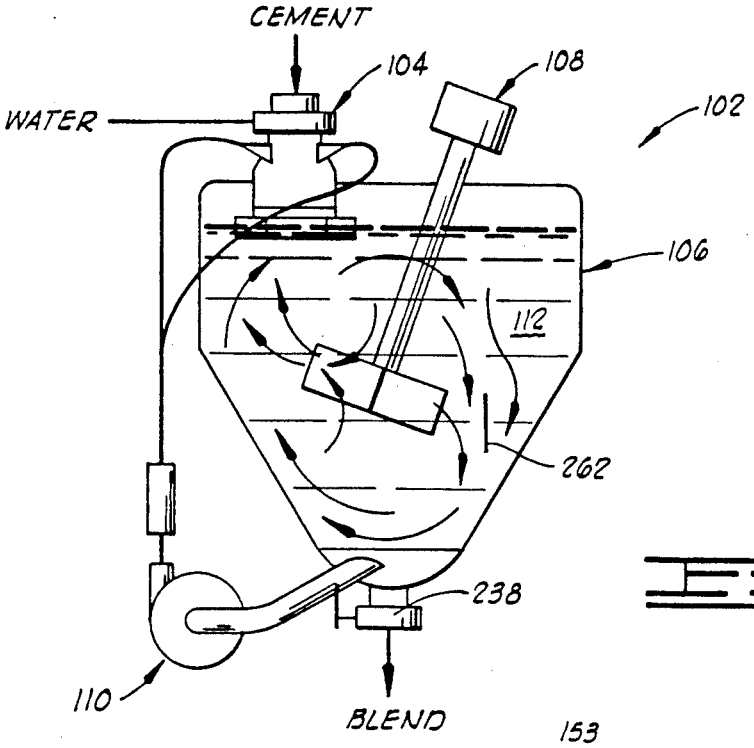
FIG. 1 is a schematic illustration of a mixing apparatus of the present invention.

Schematically depicted in FIG. 1 is a mixing apparatus 102 of the present invention. The apparatus 102 produces a mixture of at least two constituent substances. For purposes of simplicity, the following description will refer to mixing cement and water to produce a slurry for use in cementing a casing in a well bore, for example; however, the present invention is not limited to such specific substances or application. Thus, although the preferred embodiment of the present invention is particularly adapted for mixing a dry substance and a liquid, the present invention has broader utility (such as liquid and liquid, or liquid and gas).

The major components of the apparatus 102 are illustrated in FIG. 1. These include flow mixing means 104 for mixing the dry substance and the liquid in a downwardly spiraling flow; a tub 106 having the flow mixing means 104 disposed therein; an agitator 108 disposed obliquely in the tub 106 so that the agitator 108, when activated, circulates the mixture received in the tub from the flow mixing means 104; and recirculation means 110, connected to the tub 106 and to the flow mixing means 104, for recirculating the mixture from the tub 106 into the downwardly spiraling flow within the flow mixing means 104. Through the structural and functional interrelationships of these elements, a cement slurry 112 is produced within the interior volume of the tub 106. These elements will be more particularly described hereinbelow with reference to FIGS. 2–15.

Figure 2:
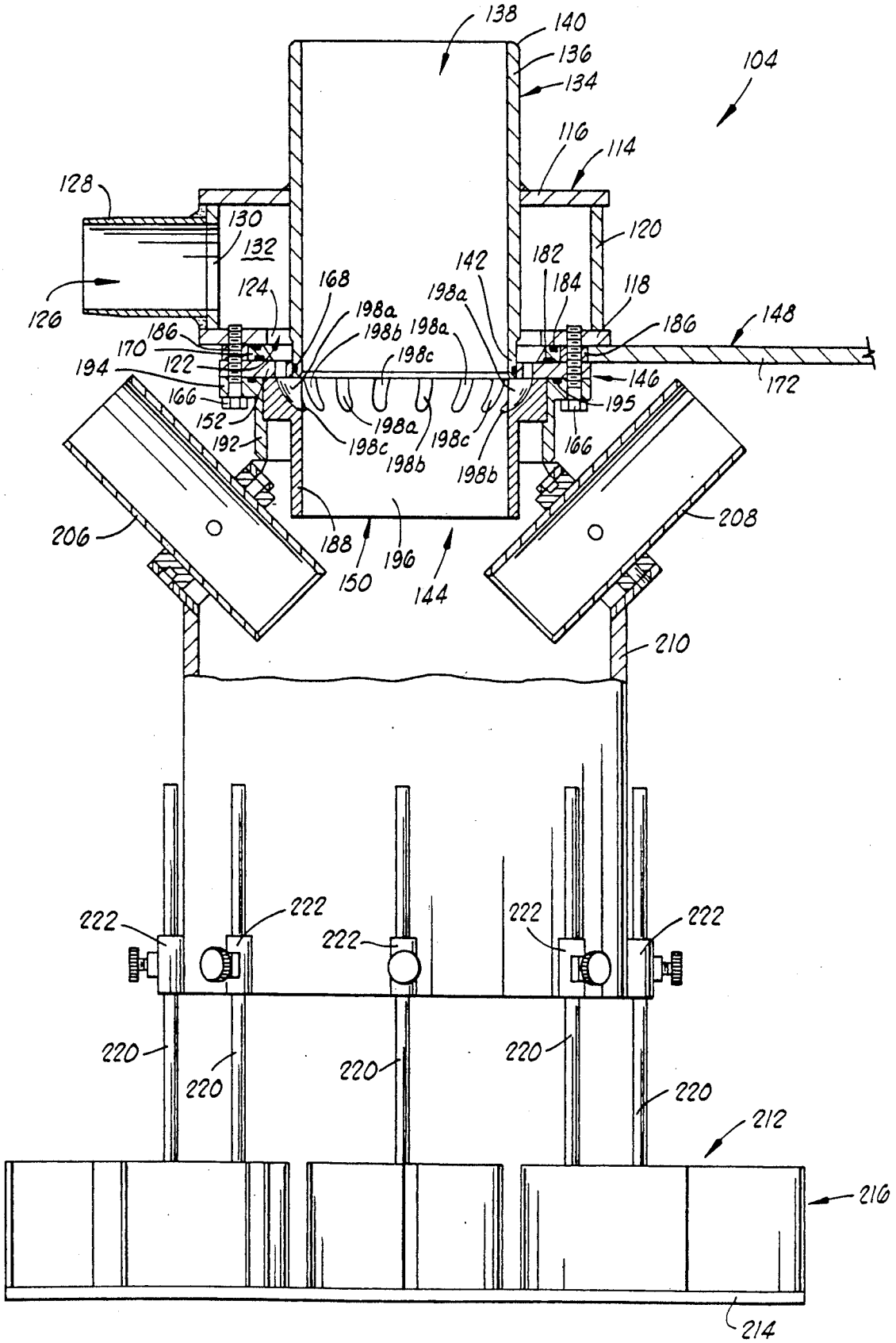
FIG. 2 is a partially sectioned elevational view of an axial flow mixer of the mixing apparatus depicted in FIG. 1.

The preferred embodiment of the flow mixing means 104 is shown in FIG. 2, and the preferred embodiment of individual components thereof are more particularly shown in FIGS. 3–11, 16 and 17.

In the preferred embodiment, the flow mixing means 104 is an axial flow mixer which conveys cement axially from the inlet to the outlet of the mixer. That is, there are no elbows or horizontal conduits through which the cement must be conveyed during its mixing with the water prior to being input into the body of slurry 112 in the tub 106. Other principle functions of the mixer 104 include:

1. add water through a single control valve to the bulk cement added through the inlet of the mixer—preferably the relationship between operation of the single control valve and the resulting water flow rate is linear (or other desirable relationship) and the water preferably should be added to utilize all or substantially all of the available water energy in the mixing process;
2. mix recirculated slurry with the incoming water and cement at increased recirculation rates to more effectively mix with the newly mixed cement and water;
3. minimize air entrainment by diffusing the energy of the recirculated and newly mixed slurry at the surface of the body of slurry 112 in the tub 106;
4. minimize cement dust by wetting dust particles before they escape the mixer;
5. eliminate the need for a water bypass valve.

These functions are implemented by the embodiment of the apparatus 104 shown in FIG. 2.

Referring to FIG. 2, the preferred embodiment of the flow mixing means 104 includes an inlet member 114 which in the preferred embodiment is an inlet manifold for the water. The inlet member 114 includes an annular top plate 116, an annular bottom plate 118 having a central opening with a larger diameter than the central opening of the plate 116, and a cylindrical side wall 120 connected, such as by welding, to and between the plates 116, 118. These components are disposed relative to each other as shown in FIG. 2 so that an axial opening 122 is defined. The bottom of the axial opening 122 provides an exit port 124 through which the water received by the manifold flows in a downward path prior to mixing with cement. This water is received through an entry port 126 defined by a horizontal (as disposed in FIG. 2) sleeve 128 connected to the side wall 120 in communication with an opening 130 defined therein. The exit port 124 communicates with the entry or inlet port 126 through an annular interior region 132 defined when the inlet member 114 is connected to an inlet member 134 received in the axial opening 122 as shown in FIG. 2. The inlet member 114 and the inlet member 134 are connected, such as by welding.

The inlet member 134 is a sleeve having a cylindrical wall 136 which defines an axial passageway 138 between top and bottom (as oriented in FIG. 2) ends 140, 142 of the sleeve 134. The top end 140 is connectable to a conventional bulk cement valve (not shown) so that the sleeve 134 receives cement through the top end 140 and directs it in a downward flow through the bottom end 142. In particular, the sleeve 134 provides a straight flow path for the cement between the outlet of the bulk cement valve and the outlet of the sleeve 134 where the cement enters a valve 144 of the flow mixing means 104.

The valve 144 meters the water to be mixed with dry cement coming from the inlet sleeve 134. The valve 144 includes an orifice plate 146, a valve plate 148 and means 150 for jetting liquid (specifically water in the example of this description) into admixture with the cement. The orifice plate 146 of a specific design contains eighteen orifices or holes, and the valve plate 148 is designed so that it opens six of the eighteen orifices first and then an additional six holes as the valve plate 148 is further rotated and ultimately the final six holes are opened upon further rotation. This allows a maximum hole dimension or passage diameter for a given flow rate as compared to a system which may have the entire passageway opening simultaneously. This controlled opening is important for contaminate passage which could block metering orifices.

The mixing water, as it exits the orifice plate 146, flows in an axial direction and is subsequently turned and directed toward the cement flow path coming from the sleeve 134. This turning of the water flow direction is produced by the jet means 150 which in the preferred embodiment has grooves coinciding with the orifice plate 146 orifices. Thus, the jet means 150 changes the direction of the mixing water from axially downward to slightly tangential and downward. This produces a downwardly spiraling column of fluid circulating about an open center or iris. In a preferred embodiment, the depths of the grooves of the jet means 150 are staggered so that with high flow rates, back flow up the passage 138 is prevented.

Figure 3:
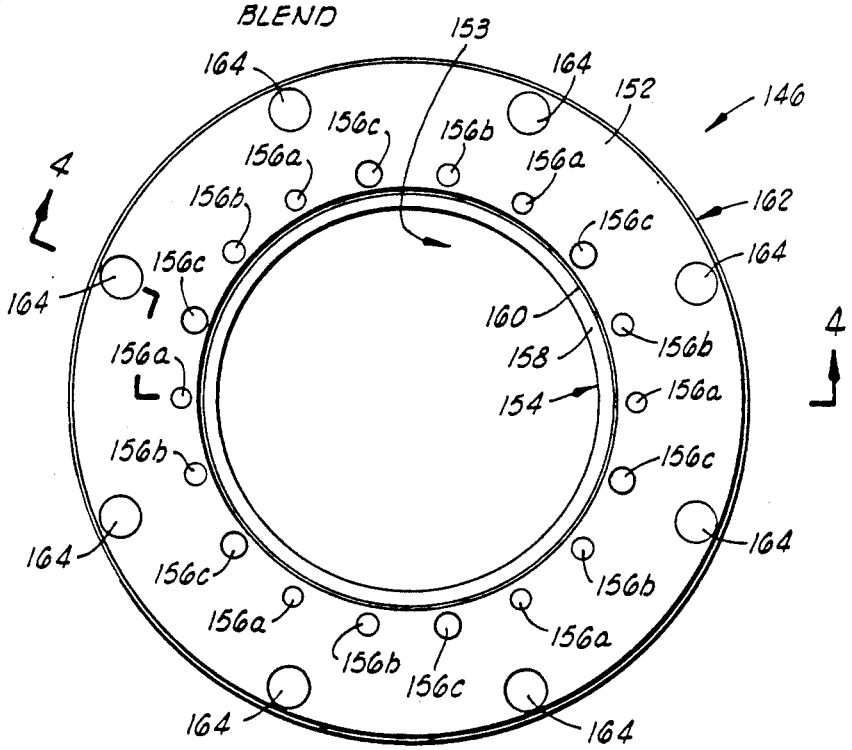
FIG. 3 is a plan view of an orifice plate of a valve of the axial flow mixer shown in FIG. 2.
Figure 4:
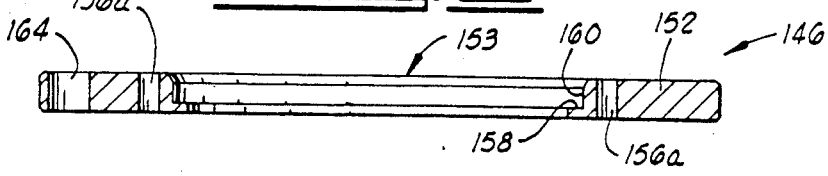
FIG. 4 is a sectioned elevational view of the orifice plate taken along line 4—4 shown in FIG. 3.

Referring to FIGS. 3 and 4, the orifice plate 146 includes an annular member 152 having a central opening 153 defined by an inner periphery 154 about which the plurality of orifices are defined. The orifices of the preferred embodiment include three sets of differently sized orifices **156*a*, 156*b*, 156*c*. Each set includes six orifices of the same size. In the illustrated embodiment, the orifices 156*a* have the smallest diameter, orifices 156*b* have a larger diameter, and the orifices 156*c* have the largest diameter of the three sets. These are spaced sequentially and equiangularly around the inner periphery 154 as best seen in FIG. 3**. The orifices can be the same size or of different sizes and different arrangements.

Also defined about the inner periphery 154 is a notch or shoulder defined by an annular surface 158 and an adjoining, perpendicularly extending cylindrical surface 160.

The annular member 152 also has an outer periphery 162 through which holes 164 are defined. The holes 164 receive retaining bolts, two of which are shown in FIG. 2 and identified by the reference numeral 166, extending through spacers 186.

When the orifice plate 146 is connected to the inlet manifold 114 by the retaining bolts 166, the orifices 156 are disposed below the exit port 124 of the inlet manifold 114. The orifice plate 146 is also concentrically disposed about the inlet sleeve 134. As shown in FIG. 2, the bottom end 142 of the sleeve 134 abuts the annular surface 158 at the inner periphery 154 of the orifice plate 146. This permits a seal ring 168 to seal against the cylindrical surface 160 of the orifice plate 146 as illustrated in FIG. 2. This also disposes the orifice plate below and adjacent the valve plate 148.

The disposition of the valve plate 148 concentrically about the inlet sleeve 134 adjacent the exit port 124 of the inlet manifold 116 is shown in FIG. 2. As disposed, the valve plate 148 is pivotably connected to the orifice plate 146 so that the position to which the valve plate 148 is pivoted determines which of the orifices 156 are open to pass liquid. The overall construction of the valve plate 148 is more clearly shown in FIGS. 5 and 6. From these drawings, it is apparent that the preferred embodiment of the valve plate 148 includes a ring 170 from which an actuating arm 172 extends radially outwardly. The arm 172 can be engaged by a suitable actuating device (not shown).

Figure 5:
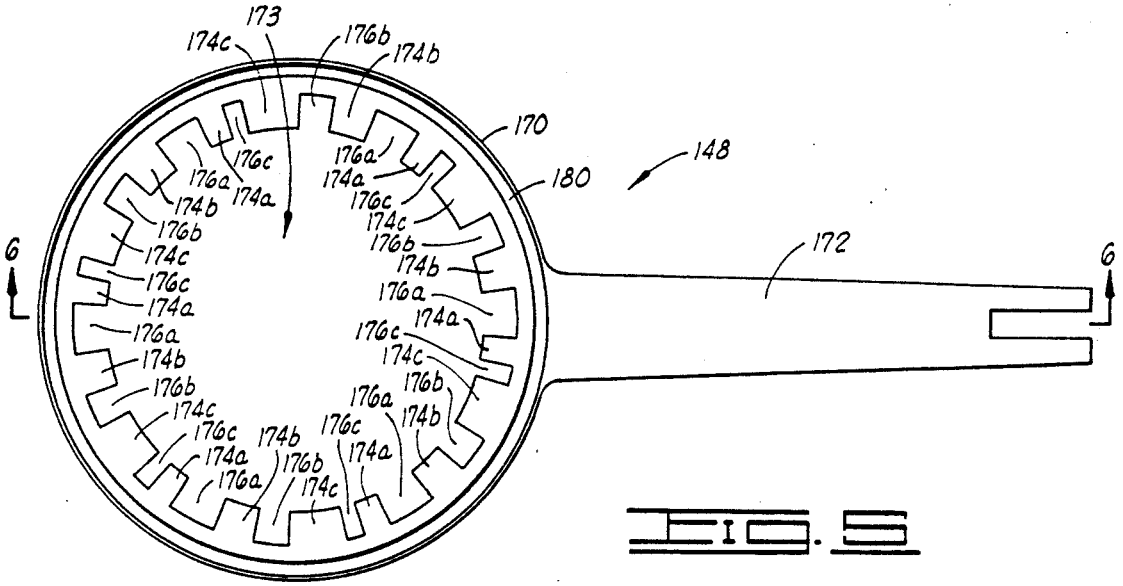
FIG. 5 is a plan view of a valve plate of the valve of the axial flow mixer shown in FIG. 2.
Figure 6:
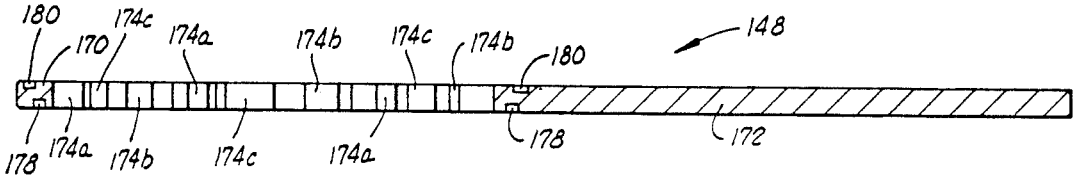
FIG. 6 is a sectioned elevational view of the valve plate taken along line 6—6 shown in FIG. 5.

The ring 170 has an outer periphery from which the arm 172 extends. The ring 170 also includes a central opening 173 defined by an inner periphery which has a notched or toothed configuration as most clearly seen in FIG. 5. This configuration includes a set of teeth **174*a*, a set of teeth 174*b* and a set of teeth 174*c*. Each of the teeth within a respective set has the same width, and the width of each of the teeth 174*c* is larger than the width of each of the teeth 174*b*. Each of the teeth 174*b* has a width larger than the width of each of the teeth 174*a*. This sizing corresponds to the different size orifices 156*a*, 156*b*, 156*c* of the orifice plate 146 and the desired sequencing for opening the orifices 156*a*, 156*b*, 156*c*. Thus, when the water metering valve 144 is fully closed, each of the teeth 174*a* overlies a respective orifice 156*a*, each of the teeth 174*b* overlies a respective orifice 156*b*, and each of the teeth 174*c* overlies a respective orifice 156*c*. This position is obtained by pivoting the valve plate 148 upwardly as shown in FIG. 5 or inwardly into the page of FIG. 2. The respective bolt 166 which lies behind the right hand side bolt 166 shown in FIG. 2 limits rotation of the valve plate 148 in this direction. The sets of orifices 156*a*, 156*b*, 156*c* are progressively opened as the actuating arm 172 of the valve plate 148 is moved clockwise for the orientation shown in FIG. 5 or out of the page for the orientation shown in FIG. 2. This direction of rotation is limited when the actuating arm abuts the right hand side bolt 166 shown in FIG. 2. Opening of an orifice 156*a*, 156*b*, 156*c* occurs when a corresponding aperture or space 176*a*, 176*b*, 176*c* defined between the teeth 174*a*, 174*b*, 174*c* overlies or registers with the respective orifice of the inner periphery of the orifice plate 146. Thus these elements of the valve plate 148 define means for simultaneously opening the orifices 156*a*, 156*b*, 156*c* of a respective set in response to pivotation of the valve plate 148. In the preferred embodiment, the sequence of opening the orifices is such that an overlap exists. For example, the set of orifices 156*b* starts to open before the set of orifices 156*a*** is fully open. This overlap makes the flow area versus position much smoother, and it can be made to approximate a straight line response if desired.

Within the body of the ring 170 there are defined two grooves 178, 180. The groove 178 is in a surface of the ring 170 facing the orifice plate 146, and the groove 180 is in a surface of the ring 170 facing opposite or away from the orifice plate 146. These receive seals (such as O-rings) 182, 184, respectively, as shown in FIG. 2 to seal against the top surface of the orifice plate 146 and the bottom surface of the inlet manifold 114, respectively. The seal groove 180 is at a greater diameter than the groove 178, thus the groove 180 encompasses a greater area of the valve plate 148 than is encompassed by the groove 178. The pressure which exists during operation acts on the greater upper surface area of the valve plate 148 sealed by the seal 184 to bias the valve plate 148 downward against the orifice plate 146, thereby minimizing leakage between the orifice plate 146 and the valve plate 148.

The valve plate 148 is retained in position by its concentric positioning with the inlet sleeve 134. This maintains the openings 153 (orifice plate 146) and 173 (valve plate 148) aligned; however, it permits the valve plate 148 to be moved relative to the orifice plate 146 so that the apertures 176 of the valve plate 148 can be selectably registered with the orifices 156 of the orifice plate 146 to control the flow of the water received from the exit port 124 of the inlet manifold 114 for mixing with the cement axially received through the axial passageway 138 of the inlet sleeve 134.

Figure 16:
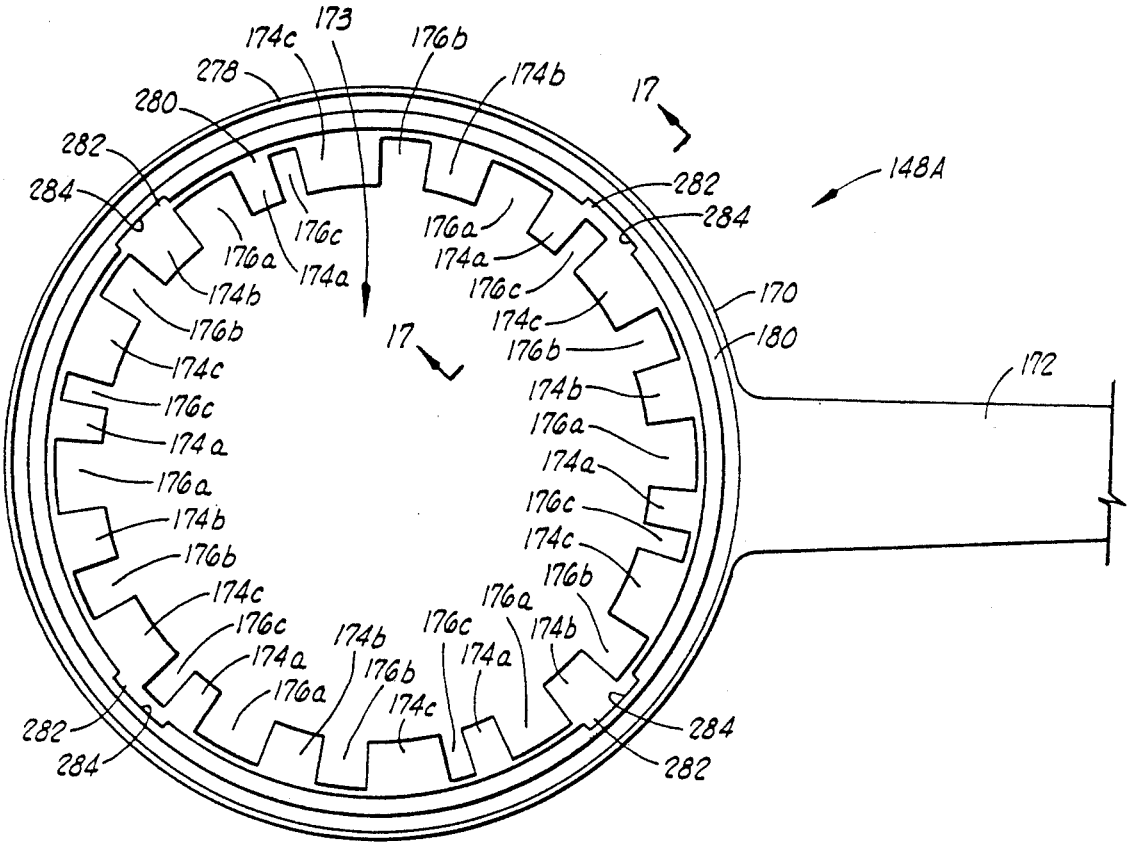
FIG. 16 is a plan view of another embodiment of the valve plate.
Figure 17:
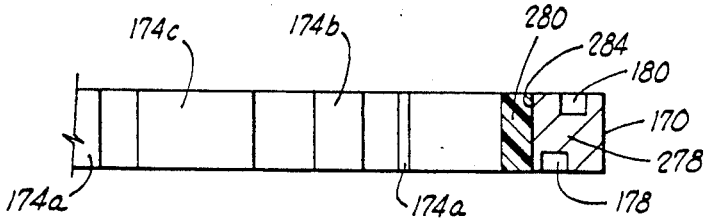
FIG. 17 is a sectional elevational view of the FIG. 16 valve plate taken along line 17—17 shown in FIG. 16.

Shown in FIGS. 16 and 17 is another embodiment of the valve plate, identified therein with the reference numeral 148A. The valve plate 148A has the same features as the valve plate 148 as indicated by the use of the same reference numerals; however, the ring 170 of the valve plate 148A includes two separable elements. One element is an annular outer support member 278 from which the actuating arm 172 extends. The support member 278 is preferably made of a suitable metal, as is the entire embodiment of the previously described valve plate 148. The other element is an annular insert 280 disposed within the support member 278 so that the insert 280 seals against the orifice plate 146 in response to pressure when a substance flows through the valve 144. The insert 280 is preferably made of a suitable material, such as a suitable plastic, which resists erosion and corrosion from substances flowing through the valve 144 and which exhibits at least some deformation to seal against the surface of the orifice plate 146 when there is flow through the valve 144. This is preferred because metal used at the inner periphery of the ring 170 can erode or corrode and also because metal-to-metal contact between the orifice plate 146 and the valve plate 148 might not create a desired seal.

The insert 280 defines the inner periphery of the ring 170 in which the teeth 174 and the apertures 176 are defined. The insert 180, itself, has an outer periphery from which protuberances 282 extend. These are releasably received in indentations 284 defined about the inner periphery of the outer support member 278. These form mortise and tenon joints which hold the insert 280 so that it rotates in response to rotation of the support member 278, but which permit the insert 280 to be separately movable linearly relative to the support member 278 (e.g., the insert 280 can be "punched out" of the joints and freed from the support member 278 when the valve 144 is disassembled).

The above-described orifice plate 146 and valve plate 148 (or 148A) are designed in the preferred embodiment to provide a valve through which fluid can be flowed at a constant velocity for different volumetric flow rates. As used herein, "constant velocity" does not mean absolutely no velocity difference, but rather the term encompasses small velocity differences which are not significant for practical purposes to which the invention is put. In the exemplary cement mixing use in the oil and gas environment referred to herein, a design achieving a velocity within five percent of nominal velocity can be considered one which provides "constant velocity," for example. An equation defining flow through an orifice is $Q=KA\sqrt{\Delta P}$, where Q is volumetric flow rate (feet$^3$/minute), K is a constant (coefficient of discharge), A is the flow cross-sectional area (feet$^2$) and $\Delta P$ is the pressure differential. For a centrifugal pump pumping water through the valve 144 of the preferred embodiment, the $\sqrt{\Delta P}$ factor can be considered substantially constant. The pump could be controlled to maintain constant pressure, but in the preferred embodiment of the valve 144 this is not deemed necessary because the effect of the actual pressure change in practice is not deemed significant. Furthermore, the sizing of the orifices 156 can be made to account for an expected change in pressure. Accordingly, rewriting the above equation as $Q/A=K\sqrt{\Delta P}$ shows that velocity (Q/A) is constant ($K\sqrt{\Delta P}$) for a practical implementation of the preferred embodiment. Through the design of the multiple orifices 156 of the orifice plate 146, the orifices 156 which are opened to flow provide a flow area $A_n$ which allows a resultant volumetric flow rate $Q_n$ so that $Q_n/A_n$=constant. That is, the orifice plate 146 defines a means for providing a selectable area through which a substance can be controllably flowed, and the valve plate 148 (or 148A) defines an adjustment means, connected to the orifice means, for permitting the opening of areas, $A_n$, through the orifice means, which areas permit flows of the substance at respective volumetric flow rates, $Q_n$, so that the substance flows through the valve 144 at a constant velocity, $Q_n/A_n$.

As shown in FIG. 2, the liquid jet means 150 is disposed adjacent the bottom end 142 of the inlet sleeve 134 and in communication with the orifice plate 146. The liquid jet means 150 directs into a circulating flow water passed through the orifice plate 146 from the downward flow from the inlet manifold 114 so that the downward flow of the cement from the inlet sleeve 134 mixes with the water in the circulating flow.

In the preferred embodiment of the jet means 150 shown in FIGS. 2 and 7–10, the circulating flow is caused by the construction of the jet means 150 which includes an axial body 188 having a plurality of grooves defined therein for directing streams of the water exiting the orifices 156 with which the apertures 176 of the valve plate 148 register so that the directed streams form a flow circulating about an axis 190 of the axial body 188. The axis 190 is aligned with the axis of the inlet sleeve 134 so that the axial body 188 is coaxially related to the inlet sleeve 134. This relationship is maintained, and the axial body 188 is connected to the previously described assembly of the flow mixer 104, by means of a retaining collar 192 having a flange 194 which carries an O-ring 195 and through which the retaining bolts 166 extend as shown in FIG. 2.

The axial body 188 of the preferred embodiment is a flanged sleeve wherein the flange is engaged by the collar 192 as shown in FIG. 2. The sleeve includes an interior surface 196 in which the plurality of grooves are defined at the flanged end of the jet means sleeve which is secured adjacent the bottom end 142 of the inlet sleeve 134, from which the sleeve or axial body 188 forms an extension. The surface 196 defines an axial passageway through the sleeve 188. The sleeve is connected to the remainder of the valve 144 so that this axial passageway is aligned with the central openings 153, 173 of the orifice plate 146 and the valve plate 148.

The grooves defined in the interior surface 196 are of three sizes and orientations to correspond to the orifices 156*a*, 156*b*, 156*c* overlaying and aligned and registering with the grooves. The grooves of these three sets are respectively identified by the reference numerals 198*a*, 198*b*, 198*c*. The shape of each of these is more clearly shown in FIGS. 8–10. Each of the grooves is formed at an angle to a radius of the cylindrical shape of the axial body 188. Each group 198 angles downwardly from a semicircular opening at the top in a manner which is oblique to the axis 190. In a preferred embodiment, the groove depths are staggered in sequential sets wherein each of three grooves within a set extends to a different depth (e.g., sequentially deep, deeper, deepest). With high flow rates, this prevents backflow up the passage 138.

Figure 7:
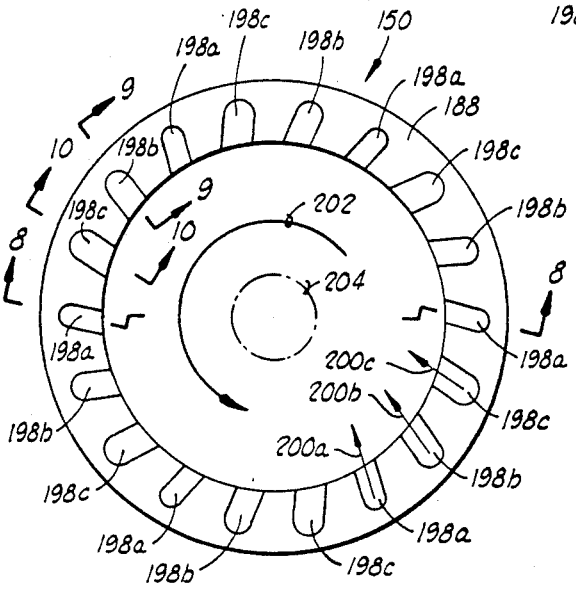
FIG. 7 is plan view of a water jet member of the valve of the axial flow mixer shown in FIG. 2.
Figure 8:
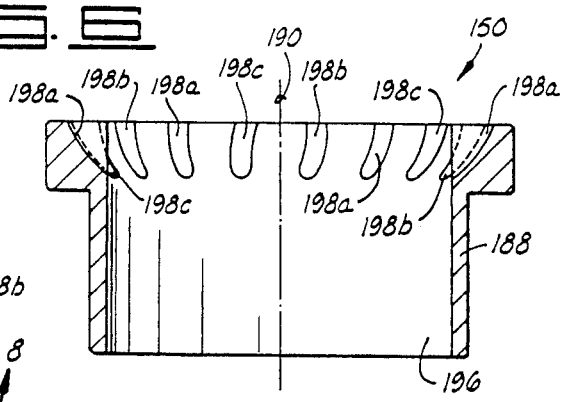
FIG. 8 is a sectioned elevational view of the water jet member taken along line 8—8 shown in FIG. 7.
Figure 9:
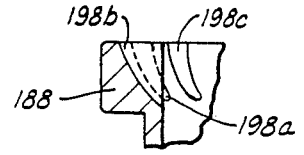
FIG. 9 is a sectioned elevational view of a corner of the water jet member taken along line 9—9 shown in FIG. 7.
Figure 10:
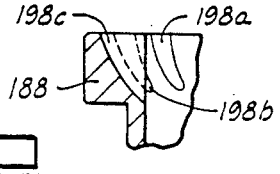
FIG. 10 is a sectioned elevational view of part of the water jet member taken along line 10—10 shown in FIG. 7.

As a result of the orientation of the grooves 198, the water received by the grooves is not angled directly downwardly or at the axis 190; rather, the water is directed at an angle as indicated by arrows 200*a*, 200*b*, 200*c* in FIG. 7. The result of this angular directing of the flow is to create a downwardly spiraling flow as indicated by the arrow 202 in FIG. 7. This forms a void 204, sometimes referred to as an iris, about the axis 190.

As a result of the aforementioned construction and operation of the orifice plate 146, valve plate 148 and liquid jet means 150, the valve 144 has a reduced susceptibility to clogging by particles in the mix water, it has a relatively fast opening response time, and it can be tailored to achieve different gains via the different orifice sizes in the orifice plate 146. This construction and operation also provides a single source of water control which permits easier manual or automatic control (i.e., only the valve plate 148 needs to be operated for water control). It also communicates more water energy from the same size pumps which have been used with prior systems. The downwardly spiraling flow created within the jet means 150, wherein an open iris is formed, helps separate entrained air from the water/cement mixture and helps break up the cement.

As further shown in FIG. 2, the flow mixer 104 also comprises at least two recirculation inlets 206, 208 substantially diametrically opposed and skewed towards the same direction as the water jetting grooves 198 of the jet means 150. That is, as illustrated in FIG. 2 the inlets 206, 208 are sleeves which are disposed in a downward direction and at a slightly tangential angle to create a circular flow pattern. Thus, when a recirculation fluid flows through the recirculation inlets 206, 208, the recirculation fluid enters the circulating flow below the jet means 150 in the same direction of circulation. The recirculation inlets 206, 208 are connected to the axial body 188 of the jet means 150 by a containment body or housing 210 as shown in FIG. 2. The containment body 210 extends below the jet means 150.

The use of at least two recirculation inlets allows a much larger volume of slurry to be recirculated with the same size pump used with prior systems. For example, a typical maximum recirculation rate in a prior system is 8–10 barrels per minute using a particular type of pump, whereas up to approximately 25 barrels per minute can be recirculated in a particular implementation of the present invention using the same type of pump. This increased volume and flow rate provides greater mixing energy within the axial flow mixer which improves wetting and breaking up of the dry material. It also permits the contents of the tub 106 to be rolled more quickly to mix the older slurry with the new mixture to make a more homogeneous product. It also enables the recirculation of thicker slurries which have been known to plug the single recirculation inlet of prior systems. Also, faster recirculation provides faster density measurement response (by means of sampling the tub contents faster).

Figure 11:
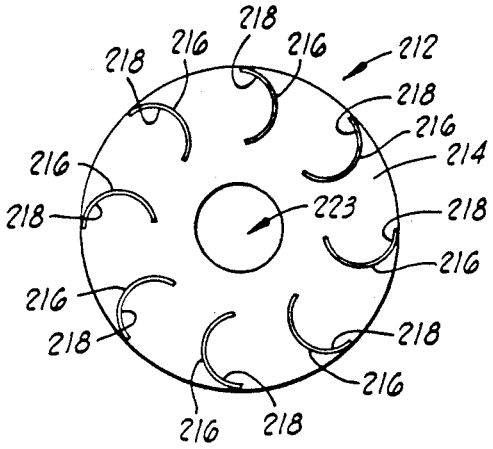
FIG. 11 is a plan view of a diffuser of the axial flow mixer shown in FIG. 2.

The flow mixing means 104 further comprises diffuser means 212 for diffusing the circulating, downwardly spiraling flow below the containment body 210 at the bottom of the mixer 104. The circulating flow is diffused by engaging the diffuser means whereupon the flow changes its direction of flow. The diffuser means 212 is a member which includes a washer-shaped or annular plate 214 to which a plurality of baffle plates 216 are connected. Each of the baffle plates 216 includes a concave surface 218 for receiving the circulating flow and changing its direction of flow. The baffle plates 216 are connected to the annular plate 214 at equally spaced intervals as best seen in FIG. 11. Although not shown, the diffuser means 212 can include a top plate to prevent or reduce vertical splashing.

The diffuser means 212 is connected to the axial body 188 of the jet means 150 by the containment body 210 and adjustment means for adjusting the distance the diffuser means 212 is disposed below the containment body 210. As shown in FIG. 2, the adjustment means includes a plurality of rods 220. The lower ends of the rods 220 are attached to the diffuser means 212; their upper ends are slideably received in thumbscrew brackets 222 attached to the lower end of the containment body 210. The adjustment means permits the diffuser means 212 to be adjusted to the surface of the body of slurry 112 when the flow mixing means 104 is disposed on the tub 106 as illustrated in FIG. 1.

The outside diameter of the diffuser means 212 is larger than the diameter of the containment body 210. The diffuser means 212 has a hole 223 in the center which is approximately the same size as the cement delivery valve. The baffles, or vanes, 216 are mounted in a direction such that the direction of rotation of the slurry as it exits the mixer's lower housing defined by the containment body 210 is reversed, thereby aiding in energy dissipation.

The diffuser means 212 dissipates energy at the surface of the body of slurry 112 when the tub 106 is up to its full operating capacity. This dissipation of energy helps reduce air entrainment. In a particular implementation, air entrainment was reduced by approximately 50% to 90% relative to the air entrainment found produced in a prior system. Having the slurry impact the diffuser means 212 also helps mixing by breaking lumps of dry material that previously have been wetted. It also causes additional mixing due to turbulence. Mixing is further enhanced by the drawing (educating) of slurry from below the diffuser through the hole 223 and mixing it with new slurry in the vane sections of the diffuser.

In the operation of the flow mixing means 104, as cement is gravity fed through the inlet sleeve 134, it first encounters the high velocity mixing water jets created within the jet means 150. The flow of the mixing water is controlled by operation of the single valve plate 148. Even at low water rates, most of the passageway through the axial body 188 of the jet means 150 is covered by the mixing water. Thus, it is difficult for cement to pass the initial mixing water section without being wetted by water. The mixture of cement and water exiting the end of the axial body 188 of the jet means 150 is intersected by the jets of recirculated slurry flowing from the recirculation inlets 206, 208. Through this two-stage high velocity mixing, the slurry circulating down the containment housing 210 is thoroughly mixed and homogeneous.

In a particular embodiment, the diffuser means 212 is positioned below the containment body 210 approximately five inches, with the diffuser means 212 submerged approximately two inches into the body of slurry 112 as depicted in FIG. 1. As the slurry exits the containment housing 210, it has a downward and slightly spiral pattern. This fluid impacts the diffuser means 212 and the tub fluid and is deflected outwardly into the vanes or baffles 216. The baffles 216 reverse the flow direction from clockwise to counterclockwise (for the illustrated embodiment), thereby aiding in energy dissipation.

Advantages achieved with the flow mixing means 104, and the reasons for these, are believed to include:

1. utilization of all the available mixing water energy—this is accomplished with the novel water metering valve 144 which includes the orifice plate 146, the valve plate 148 and the water jet means 150;
2. increased completeness of the mixing process within the mixer before the mixture enters the tub 106—this results from capturing all of the mixing water energy, having the mixing water cover the cement flow path, having the recirculated fluid intersect the newly mixed cement, increasing the recirculation rate, and having the mixture impact the diffuser means 212;
3. reduced air entrainment—this is accomplished by preventing the mixture from jetting straight down through the mixer into the tub 106;
4. reduced dust—this is accomplished by having the mixture exit the containment body 210 in a curtain-like manner so that any expelled air and dust must penetrate the curtain to get outside thus being wetted before it escapes;
5. eliminates water bypass valves—this is accomplished by providing adequate water flow rate via the water metering valve 144;
6. reduced or eliminated cement buildup in the flow mixing means 104—this is accomplished by combining both the axial design with the high recirculating rates and energy.

The tub 106 of the preferred embodiment in which the mixer 104 is mounted has a shape as illustrated in FIGS. 12–15. This shape includes a cross-sectional area at its top or mouth which is larger than the cross-sectional area at the bottom of the tub 106. Having a larger area at the top helps expel entrained air, and a smaller area at the bottom enables a faster response time in turning over the slurry and making it into a homogeneous mixture.

Figure 12:
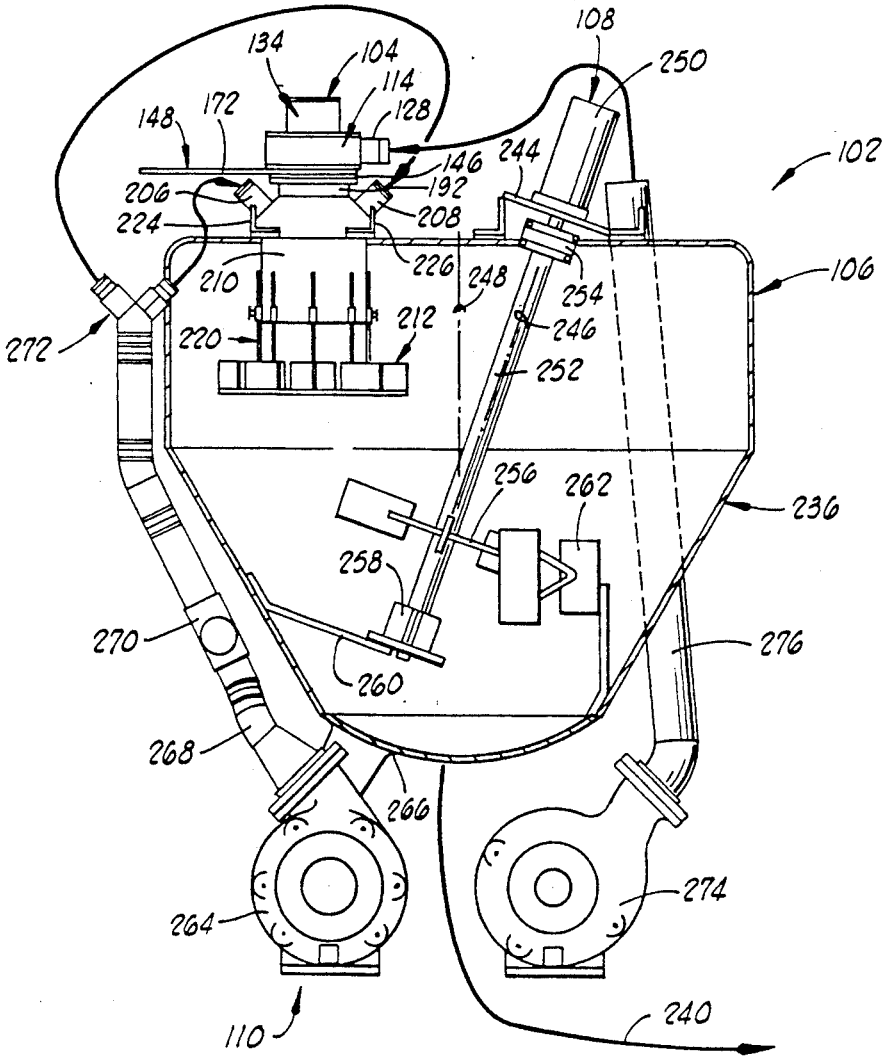
FIG. 12 is an elevational view of the preferred embodiment of the mixing apparatus schematically depicted in FIG. 1.
Figure 13:
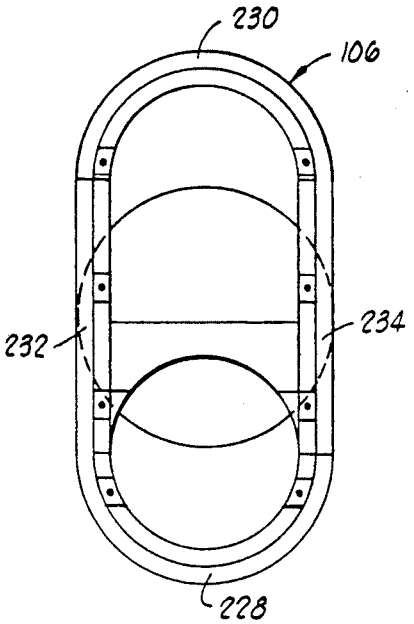
FIG. 13 is a plan view of a tub of the mixing apparatus shown in FIG. 12.

As shown in FIGS. 12–15, the larger area at the top of the tub 106 is maintained throughout a sufficient height of the tub to accommodate receiving the lower portions of the mixer 104 which is shown in FIG. 12 installed on two mounting brackets 224, 226. Throughout this height, the tub 106 is defined by two curved ends 228, 230 connected by two straight side sections 232, 234 (in FIG. 13).

Below the constant cross-sectional area just described is a tapered portion 236 at the bottom of which an outlet valve 238 (FIG. 1) is connected. The outlet line from the tub 106 is represented in FIG. 12 by the dashed line 240.

Figure 14:
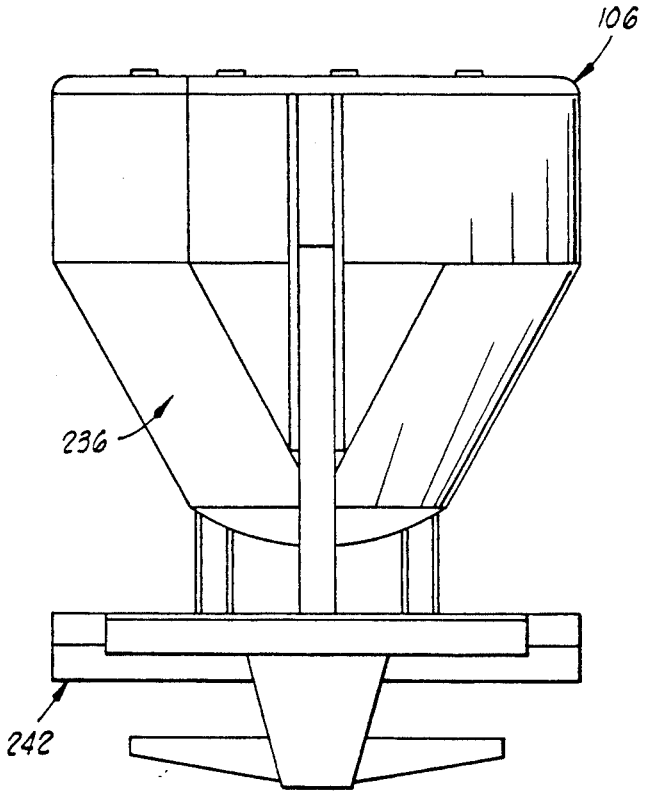
FIG. 14 is an elevational view of the tub of the mixing apparatus of FIG. 12 shown mounted on a skid.
Figure 15:
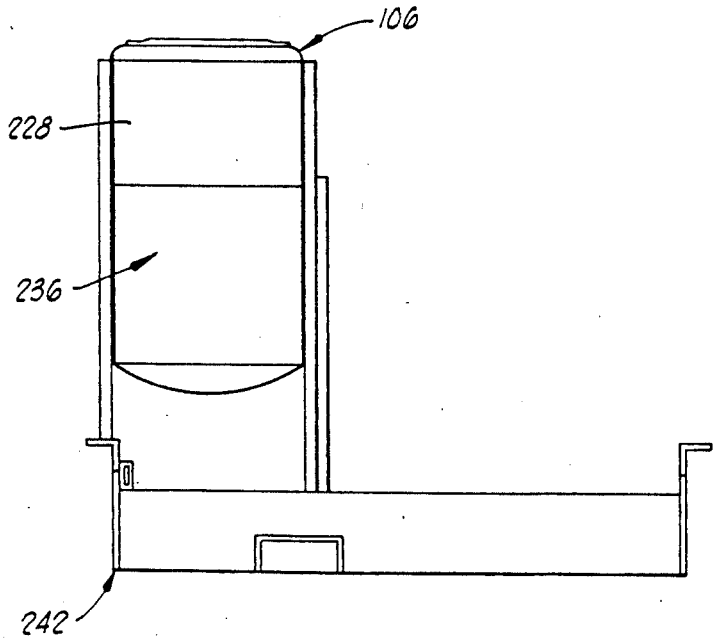
FIG. 15 is another elevational view of the tub of the mixing apparatus of FIG. 12 shown mounted on the skid.

The tub 106 can be used in a number of different ways known in the art. As illustrated in FIGS. 14 and 15, one way is to mount the tub on an underlying skid 242 by which the tub 106 can be mounted on a wheeled trailer (not shown).

Referring to FIG. 12, the preferred embodiment of the agitator 108 of the mixing apparatus 102 will be described. A mounting bracket 244 secures the agitator 108 to the tub 106 in the oblique relationship illustrated in the drawings. That is, the bracket 244 retains the agitator 108 so that its axis of rotation 246 is neither parallel nor perpendicular to an axis 248 of the tub 106.

Mounted on the bracket 244 is a hydraulic drive motor 250 to which a driven shaft 252 is connected through a flexible drive coupling 254. Connected to the shaft 252 is a paddle 256. The shaft 252 is journaled opposite the coupling 254 in a bearing 258 connected by a bracket 260 to a side wall of the tapered portion 236 of the tub 106.

The paddle 256 of a particular embodiment has a twenty-two inch diameter versus a more conventional twelve-inch diameter paddle used in one or more prior systems. The larger diameter paddle of the present invention in combination with the torque which can be generated by the motor 250 enable more viscous slurries to be agitated using the present invention. The agitation which typically occurs includes a flow pattern as illustrated in FIG. 1 by the arrows drawn within the body of slurry 112. This arises from the action of the paddle 256 in combination with a baffle 262 and the incoming mixture received from the mixer 104. The circulation illustrated in FIG. 1 shows that the present invention imparts a high rolling action to thoroughly mix the body of slurry 112 into a homogeneous mixture.

The recirculation means 110 of the mixing apparatus 102 has a preferred embodiment illustrated in FIG. 12. This includes a pump 264 having a suction side connected to an outlet 266 of the tub 106 and a pressure side connected to a conduit 268 in which a densimeter 270 is disposed. The conduit 268 has a Y-connection 272 to provide two lines for connecting to the two recirculation inlets 206, 208. Other configurations, such as having the Y-connector between the pump 264 and the densimeter 270, can be used.

Also shown in FIG. 12 is a pump 274 for pumping mix water through a conduit 276 into the inlet port 126 of the inlet manifold 114 of the mixer 104.

The operation of the overall mixing apparatus 2 of the preferred embodiment includes circulating the body of slurry 112 in the manner described and illustrated in FIG. 1 and recirculating that body through the recirculation means 110 for remixing in the mixer 104 whose operation has already been described. New mixing water is added via the pump 274 and conduit 276, and new cement is added through a cement inlet valve (not shown) in a manner known in the art. The cement inlet valve is coupled to the top end 140 of the inlet sleeve 134.

With regard to the particular utility of the present invention in the oil and gas industry, cementing job quality can be improved and thicker slurries can be mixed at higher rates with the mixing apparatus 102. Job quality improvement arises from better mixing to make a more homogeneous mixture, faster recirculation for permitting faster sampling, reduced air entrainment for more accurate measurement of density, and reduced free water content of the mixed slurry. These result at least in part from the increased mixing energy. Thick slurries can be mixed at higher rates by using the high-energy initial mixer 104, by increasing the rolling action in the tub 106 by using the larger and higher horsepower agitator 108 and by increasing the recirculation rate through the recirculation means 110. Important differences between the present invention and prior systems include at least two recirculating inlets in the flow mixer 104, the water jets created within the single water metering valve 144, the high rolling action agitation which aids in wetting cement and subsequent homogenization. Thus, the present invention is well adapted to carry out the objects and attain the ends and advantages mentioned above as well as those inherent therein. While a preferred embodiment of the invention has been described for the purpose of this disclosure, changes in the construction and arrangement of parts can be made by those skilled in the art, which changes are encompassed within the spirit of this invention as defined by the appended claims.

What is claimed is:

1. An axial flow mixer, comprising:

a first inlet member, said first inlet member having defined therein an entry port and an axial opening, said axial opening including an exit port communicating with said entry port;

a second inlet member, said second inlet member received in said axial opening of said first inlet member and said second inlet member having an axial passageway defined therethrough;

an orifice plate connected to said first inlet member, said orifice plate having defined therein a plurality of orifices disposed below said exit port of said first inlet member; and a valve plate having a plurality of apertures defined therein, said valve plate disposed between said first inlet member and said orifice plate for movement relative thereto so that said apertures of said valve plate can be selectably registered with said orifices of said orifice plate to control the flow of a liquid communicated through said entry port of said first inlet member for mixing with a substance received through said axial passageway of said second inlet member.

2. An axial flow mixer as defined in claim 1, further comprising an axial body connected to said orifice plate in coaxial relation to said second inlet member, said body having a plurality of grooves defined therein for directing streams of the liquid exiting said orifices with which said apertures register so that the directed streams form a flow circulating about the axis of said axial body.

3. An axial flow mixer as defined in claim 2, further comprising at least two recirculation inlets connected to said axial body.

4. An axial flow mixer as defined in claim 3, further comprising a diffuser member connected to said axial body so that said circulating flow engages said diffuser member for changing the direction of flow of said circulating flow.

5. An axial flow mixer as defined in claim 2, further comprising a diffuser member connected to said axial body so that said circulating flow engages said diffuser member for changing the direction of flow of said circulating flow.

6. An axial flow mixer as defined in claim 1, wherein said orifice plate includes an annular member having an inner periphery about which said plurality of orifices are defined.

7. An axial flow mixer as defined in claim 6, wherein said valve plate includes a ring from which an actuating arm extends, said ring having an inner periphery in which said plurality of apertures are defined and said ring disposed above and adjacent said annular member of said orifice plate so that said apertures overlie said inner periphery of said annular member about which said orifices are defined.

8. An axial flow mixer as defined in claim 7, wherein said ring includes:

an outer support member connected to said actuating arm; and an insert defining said inner periphery in which said plurality of apertures of said valve plate are defined, said insert disposed within said outer support member so that said insert seals against said orifice plate in response to pressure existing when the liquid and the substance are mixed by said axial flow mixer.

9. An axial flow mixer as defined in claim 1, wherein said valve plate has first and second seal-receiving grooves defined therein, said first seal-receiving groove defined at a first diameter on a surface of said valve plate facing said first inlet member and said second seal-receiving groove defined at a second diameter on a surface of said valve plate facing said orifice plate, said first diameter greater than said second diameter, whereby said first diameter encompasses a greater area of said valve plate than said second diameter, so that pressure within said axial flow mixer during mixing biases said valve plate towards said orifice plate.

10. An apparatus for mixing a dry substance and a liquid, comprising:

an inlet manifold which receives a liquid through an inlet port thereof and directs the liquid in a downward flow through an exit port thereof;

an inlet sleeve which receives a dry substance through a top end thereof and directs the dry substance in a downward flow through a bottom end thereof, said inlet sleeve disposed through said inlet manifold;

a valve plate concentrically disposed about said inlet sleeve adjacent said exit port of said inlet manifold through which the liquid downwardly flows;

an orifice plate concentrically disposed about said inlet sleeve adjacent said valve plate; and liquid jet means, disposed adjacent said bottom end of said inlet sleeve in communication therewith and in communication with said orifice plate, for directing into a circulating flow liquid passed through said orifice plate from the downward flow from said inlet manifold as controlled by said valve plate so that the downward flow of the dry substance directed by said inlet sleeve mixes with the liquid in the circulating flow.

11. An apparatus as defined in claim 10, wherein said liquid jet means includes a jet sleeve connected as an extension from said bottom end of said inlet sleeve, said jet sleeve including an interior surface in which a plurality of grooves are defined at the end of said jet sleeve adjacent said bottom end of said inlet sleeve.

12. An apparatus as defined in claim 11, wherein said orifice plate includes a plurality of orifices overlaying and registering with said plurality of grooves.

13. An apparatus as defined in claim 10, further comprising:

a containment body extending below said liquid jet means;

a first recirculation inlet disposed in said containment body; and a second recirculation inlet disposed in said containment body.

14. An apparatus as defined in claim 13, wherein said first and second recirculation inlets are disposed so that when a recirculation fluid flows therethrough, the recirculation fluid enters the circulating flow from said liquid jet means in the same direction of circulation.

15. An apparatus as defined in claim 13, further comprising:

diffuser means for diffusing the circulating flow below said containment body; and connector means for connecting said diffuser means to said containment body.

16. An apparatus as defined in claim 15, wherein said diffuser means includes:

an annular plate; and a plurality of baffle plates connected to said annular plate, each of said baffle plates including a concave surface for receiving the circulating flow and changing the direction of flow thereof.

17. An apparatus as defined in claim 15, wherein said connector means includes adjustment means for adjusting the distance said diffuser means is disposed below said containment body.

18. An apparatus as defined in claim 10, wherein said valve plate includes:

an outer support member; and an insert disposed within said outer support member so that said insert seals against said orifice plate in response to pressure within said apparatus during mixing the dry substance and the liquid.

19. An apparatus as defined in claim 10, wherein said valve plate has first and second seal-receiving grooves defined therein, said first seal-receiving groove defined at a first diameter on a surface of said valve plate facing said inlet manifold and said second seal-receiving groove defined at a second diameter on a surface of said valve plate facing said orifice plate, said first diameter greater than said second diameter, whereby said first diameter encompasses a greater area of said valve plate than said second diameter, so that pressure within said apparatus during mixing biases said valve plate towards said orifice plate.

20. An apparatus for producing a mixture from a dry substance and a liquid, comprising:

flow mixing means for mixing a dry substance and a liquid in a downwardly spiraling flow, said flow mixing means including at least two recirculation inlets;

a tub having said flow mixing means disposed therein, said tub having a larger cross-sectional area at its top than at its bottom;

an agitator disposed obliquely in said tub so that said agitator, when activated, circulates a mixture received in said tub from said flow mixing means; and recirculation means, connected to said tub and to said at least two recirculation inlets, for recirculating the mixture from said tub into the downwardly spiraling flow within said flow mixing means.

21. An apparatus as defined in claim 20, wherein said flow mixing means further includes diffuser means for diffusing the downwardly spiraling flow at the bottom of said flow mixing means.

22. An apparatus as defined in claim 21, wherein said diffuser means includes:

an annular plate; and a plurality of baffle plates connected at spaced intervals to said annular plate.

23. An apparatus as defined in claim 20, wherein said flow mixing means further includes:

a first inlet member, said first inlet member having defined therein an entry port, through which the liquid is received, and an axial opening, said axial opening including an exit port communicating with said entry port;

a second inlet member, said second inlet member received in said axial opening of said first inlet member and said second inlet member having an axial passageway defined therethrough through which the dry substance is received;

an orifice plate connected to said first inlet member, said orifice plate having defined therein a plurality of orifices disposed below said exit port of said first inlet member; and a valve plate having a plurality of apertures defined therein, said valve plate disposed between said first inlet member and said orifice plate for movement relative thereto so that said apertures of said valve plate can be selectably registered with said orifices of said orifice plate to control the flow of the liquid communicated through said entry port of said first inlet member for mixing with the dry substance received through said axial passageway of said second inlet member.

24. An apparatus as defined in claim 20, wherein said flow mixing means further includes:

an inlet manifold which receives the liquid through an inlet port thereof and directs the liquid in a downward flow through an exit port thereof;

an inlet sleeve which receives the dry substance through a top end thereof and directs the dry substance in a downward flow through a bottom end thereof, said inlet sleeve disposed through said inlet manifold;

a valve plate concentrically disposed about said inlet sleeve adjacent said exit port of said inlet manifold through which the liquid downwardly flows;

an orifice plate concentrically disposed about said inlet sleeve adjacent said valve plate; and liquid jet means, disposed adjacent said bottom end of said inlet sleeve in communication therewith and in communication with said orifice plate, for directing into the downwardly spiraling flow liquid passed through said orifice plate from the downward flow from said inlet manifold as controlled by said valve plate so that the downward flow of the dry substance directed by said inlet sleeve mixes with the liquid in the downwardly spiraling flow.

25. A valve, comprising:

an orifice plate having a plurality of orifices defined therein;

a valve plate pivotably connected to said orifice plate so that the position to which said valve plate is pivoted determines which of said orifices are open to pass a liquid; and jet means, connected to said orifice plate, for directing into a circulating flow liquid passed through open orifices of said orifice plate.

26. A valve as defined in claim 25, wherein said orifices of said orifice plate include at least three sets of orifices wherein the orifices within a respective set are the same size but are a different size from the orifices of the other sets.

27. A valve as defined in claim 26, wherein said valve plate includes means for simultaneously opening the orifices of a respective set in response to pivotation of said valve plate.

28. A valve as defined in claim 25, wherein said jet means includes a body having a plurality of grooves defined therein, said body connected to said orifice plate so that said grooves are aligned with said orifices.

29. A valve, comprising:

an orifice plate having a plurality of orifices defined therein;

a valve plate pivotably connected to said orifice plate so that the position to which said valve plate is pivoted determines which of said orifices are open to pass a liquid, wherein said valve plate includes:

an outer support member; and an insert disposed within said outer support member so that said insert seals against said orifice plate in response to pressure when a substance flows through said valve.

30. A valve as defined in claim 29, wherein:

said outer support member includes an inner periphery having an indentation; and said insert includes an outer periphery having a protuberance received in said indentation so that said insert rotates in response to rotation of said outer support member but said insert is separately movable linearly relative to said outer support member.

31. A valve, comprising:

an orifice place having a plurality of orifices defined therein;

a valve plate pivotably connected to said orifice plate so that the position to which said valve plate is pivoted determines which of said orifices are open to pass a liquid, wherein said valve plate has first and second seal-receiving grooves defined therein, said first seal-receiving groove defined at a first diameter on a surface of said valve plate facing oppositely from said orifice plate and said second seal-receiving groove defined at a second diameter on a surface of said valve plate facing said orifice plate, said first diameter greater than said second diameter, whereby said first diameter encompasses a greater area of said valve plate than said second diameter, so that pressure during flow through said valve biases said valve plate towards said orifice plate.

32. A valve, comprising:

a member having an inner periphery which defines an opening and about which a plurality of orifices are disposed;

means, connected to said member, for controlling which of said orifices are open to pass a substance; and a sleeve connected to said member in alignment with said opening thereof, said sleeve including means for directing the substance passed through open orifices of said member into a spiral flow adjacent said sleeve so that an axial void is defined by the flow within said sleeve.

33. A valve as defined in claim 32, wherein said orifices of said member include at least three sets of orifices wherein the orifices within a respective set are the same size but are a different size from the orifices of the other sets.

34. A valve as defined in claim 32, wherein said means for controlling includes a ring having an inner periphery including a plurality of teeth aligned with said inner periphery of said member in overlaying relation to said orifices.

35. A valve as defined in claim 34, wherein said ring includes:

an outer support member; and an inner plastic insert defining said inner periphery of said ring, said insert releasably connected to said outer support member.

36. A valve for controlling the addition of water to a flow of dry cement, comprising:

an annular plate having a plurality of orifices defined around an inner periphery of said annular plate, said inner periphery defining an opening through said annular plate;

a valve plate connected to said annular plate, said valve plate including a ring having a plurality of teeth spaced around an inner periphery of said ring so that spaces between said teeth register with at least some of said orifices of said annular plate in response to movement of said valve plate relative to said annular plate, said inner periphery of said ring defining an opening therethrough aligned with said opening of said annular plate; and an axial body connected to said annular plate, said axial body having an axial passageway defined therethrough aligned with said openings of said annular plate and said valve plate, and said axial body having a plurality of grooves defined therein aligned with said orifices of said annular plate so that corresponding ones of said grooves direct water passed through said orifices which register with spaces of said ring of said valve plate into mixture with dry cement flowing through said aligned openings and passageway of said annular plate, valve plate and axial body.

37. A valve as defined in claim 36, wherein said orifices of said annular plate include at least three sets of orifices wherein the orifices within a respective set are the same size but are a different size from the orifices of the other sets.

38. A valve as defined in claim 36, wherein said grooves are skewed so that said grooves direct the passed water in a downwardly direction spiraling about an axial void.

39. A valve, comprising:

orifice means for providing a selectable area through which a substance can be controllably flowed; and adjustment means, connected to said orifice means, for permitting the opening of areas, $A_n$, through said orifice means, which areas permit flows of the substance at respective volumetric flow rates, $Q_n$, so that the substance flows through said valve at a constant velocity, $Q_n/A_n$.

40. A valve as defined in claim 39, wherein:

said orifice means includes an orifice plate having a plurality of orifices defined therein; and said adjustment means includes a valve plate pivotably connected to said orifice plate so that the position to which said valve plate is pivoted determines which of said orifices are open to pass a liquid.

41. A valve as defined in claim 40, wherein said orifices of said orifice plate include at least three sets of orifices wherein the orifices within a respective set are the same size but are a different size from the orifices of the other sets.

42. A valve as defined in claim 41, wherein said valve plate includes means for simultaneously opening the orifices of a respective set in response to pivotation of said valve plate.

43. A valve as defined in claim 39 wherein:

said orifice means includes a member having an inner periphery which defines an opening and about which a plurality of orifices are disposed; and said adjustment means includes a ring having an inner periphery including a plurality of teeth aligned with said inner periphery of said member in overlaying relation to said orifices.

* * * * *